US006889844B1

(12) United States Patent
Manlapig et al.

(10) Patent No.: US 6,889,844 B1
(45) Date of Patent: May 10, 2005

(54) COLLECTORLESS FLOTATION

(75) Inventors: Emmanuel Salvador Viana Manlapig, Chapel Hill (AU); Alfredo Percy Vargas, La Paz (BO)

(73) Assignee: MIM Holdings Limited, Brisbane (AU)

( * ) Notice: Subject to any disclaimer, the term of this patent is extended or adjusted under 35 U.S.C. 154(b) by 0 days.

(21) Appl. No.: 09/787,051

(22) PCT Filed: Sep. 14, 1999

(86) PCT No.: PCT/AU99/00772

§ 371 (c)(1),
(2), (4) Date: Jun. 11, 2001

(87) PCT Pub. No.: WO00/15346

PCT Pub. Date: Mar. 23, 2000

(30) Foreign Application Priority Data

Sep. 15, 1998 (AU) ..... PP5943

(51) Int. Cl.[7] ..... B03D 1/02; B03D 1/24
(52) U.S. Cl. ..... 209/164; 209/166
(58) Field of Search ..... 209/166, 167, 209/164

(56) References Cited

U.S. PATENT DOCUMENTS 4,561,970 A * 12/1985 Heimala et al.

FOREIGN PATENT DOCUMENTS

| | | |
|---|---|---|
| AU | 38199/85 | 8/1985 |
| WO | WO 93/04783 | 3/1993 |
| WO | WO 95/21698 | 8/1995 |
| WO | WO 97/03754 | 2/1997 |

OTHER PUBLICATIONS

Ahn et al, "Effect of grinding media–chalcopyrite interaction on the self–induced flotation of chalcopyrite", International Journal of Mineral Processing, 33 (1991) pp. 243–262. Elsevier Science Publishers, Amersterdam.*

Kennedy, "The Jameson Flotation Cell", Mining Magazine, Oct. 1990 pp. 281+.*

Trahar, "Pulp potential in sulfide flotation" in Principles of Mineral Flotation–The Work Symposium, (editors M. H. Jones and J. T. Woodcock), pp 117–135 (The Australasian Institute of Mining and Metallurgy: Melbourne).*

International Search Report for PCT/AU99/00772.

* cited by examiner

*Primary Examiner*—Thomas M. Lithgow
(74) *Attorney, Agent, or Firm*—Merchant & Gould P.C.

(57) ABSTRACT

The present invention relates to a process for improving the recovery of valuable sulphide minerals. The process involves determining an Eh range within which the valuable sulphide mineral may be recovered by flotation without the need of a collector. The slurry is then subjected to flotation in a pneumatic cell (50) at such a speed that the slurry remains within the Eh range during flotation. The process substantially reduces or totally eliminates the need for collector. For mixed ores such as chalcopyrite/chalcocite chalcopyrite is recovered without collector, while some non xanthate collector may be required to recover chalcocite.

20 Claims, 7 Drawing Sheets

COLLECTORLESS FLOTATION

TECHNICAL FIELD

The present invention relates to froth flotation and particularly, but not only, flotation processes which reduce the quantity of collector required.

BACKGROUND ART

Froth flotation is a well-known process for separating valuable minerals from the remaining gangue in a mineral ore body. To obtain the valuable mineral, the ore is firstly ground, for example, in an AG, SAG or rod mill which is often followed by further grinding in a ball mill. The resultant slurry is then passed through a particle sizing apparatus such as a cyclone to limit the size of the particles to a predetermined value eg 0.1–05 mm.

Traditionally, collectors, frothers, activators and various other additives are added to the slurry prior to its entry into the rougher/scavenger circuit where the desired valuable mineral is floated off from the remaining tail. The resultant concentrate is then fed to a cleaner/re-cleaner flotation circuit to undergo further processing. Optionally, more collector/frother malt be added at this time and the slurry may be reground prior to entry into the cleaner/re-cleaner circuit.

It is vital to successful flotation to maintain the hydrophobic nature of at least the surface of the valuable sulphide mineral. This is ordinarily accomplished by adding an anionic collector to the slurry. It is important, however, to add the correct collector and in the correct amount.

There has to date been several previous studies in regard to collectorless flotation of minerals, for example, chalcopyrite. If chalcopyrite ore is broken in a clean environment and subjected to flotation with air in an aqueous environment, it has been shown to form a metal deficient sulphide. If the material is oxidised further it is believed that it forms iron hydroxide and elemental sulphur. The form of the equation for some metal sulphide minerals in alkaline environments is as follows:

$$MS+xH_2O=M^{1-x}S+xMO+2xH^++2e$$

If the metal sulphide is oxidised further then the sulfur ends up being elemental sulfur as shown in the following equation:

$$MS+2H_2O=M(OH)_2+S^0+2H^++2e^-$$

The metal deficient sulphide $M_{1-x}S$ and the sulfur element $S^0$ are the hydrophobic species. Flotation can happen as long as the metal oxides/hydroxides formed by the reaction are solubilised. Excessive oxidation can produce thiosalts and ultimately sulphate. These ions together with the metal ions may react and re-adsorb as hydrolysis products on to the mineral producing hydrophilic surfaces.

With chalcopyrite the equation forming the sulfur element is:

$$CuFeS_{2+3}H_2O=CuS+Fe(OH)_3+S^0+3H^++3e$$

The collectorless flotation of chalcopyrite requires that the flotation occurs in a neutral or slightly oxidising environment. Previous studies have shown that freshly fractured flotation of chalcopyrite increased when the redox potential (Eh) was in the neutral or slightly oxidising region. The flotation process also requires that the surface of the minerals being floated be as clean as possible. Previous studies have compared the effects on flotation recovery of a freshly fractured sulphide mineral versus an ore air oxidised for three weeks. The result was that the air oxidised minerals did not achieve the same recovery as the freshly fractured minerals.

Accordingly, it would appear that collectorless flotation of sulphide minerals is less likely to proceed unless the mineral surfaces are clean and the flotation is conducted in an oxidising environment. There are a number of situations which may cause the surfaces of mineral not to remain clean including:

- iron ions (from metal balls or mill liners) in solution after the ore has been through the ball mill. These ions may then form hydroxide which may deposit on the surface of the minerals,
- recycled water containing ions that eventually react with metal ions in the system and then re-adsorb on the surfaces of the minerals.

There are a number of techniques which have been previously attempted to reduce the amount of these materials remaining on the surfaces of the particles including high intensity conditioning vessels and cleaning agents like sodium sulphide. Collectors like xanthate have also been suggested to perform the function of cleaning the surface of the minerals of these hydroxides in the first instance. Once the surfaces have been cleaned, the sulphide mineral can float due to the collector which attaches to the mineral making it hydrophobic.

As mentioned above, although there is some dispute, it is generally thought that collectorless flotation of certain sulphide minerals require an oxidising environment.

All flotation machines can be arranged to provide an oxidising environment required by the reaction to render the sulphide mineral particles hydrophobic. However, as indicated above, if oxidation proceeds too far, thiosalt and eventually sulphate may form from the sulfur oxidation which may react with a metal ion in the solution forming metal sulphide.

This is a perennial problem with conventional production mechanical flotation cells when attempting collectorless flotation. The residence time for a typical mechanical cell is about three to five minutes. This long residence time and the increased Eh in a mechanical cell causes excessive oxidation of the slurry thereby producing hydrolysis products which deposit on the surface of the minerals and may render them hydrophilic in nature ie difficult to float.

The present invention seeks to overcome at least some of the disadvantages of the prior art or provide a commercial alternative thereto.

DISCLOSURE OF THE INVENTION

In a first aspect, the present invention provides a process for recovery of a valuable sulphide mineral comprising, providing a slurry containing the valuable sulphide mineral, determining an Eh range within which the mineral may be recovered by flotation without the need of a xanthate collector,

- and subjecting the slurry to flotation in a pneumatic cell at such a rate that the slurry remains in that Eh range during flotation.

In a preferred embodiment, flotation in the pneumatic flotation cell is conducted in a neutral or slightly oxidising environment.

In another preferred embodiment, the residence time in the pneumatic cell is below about two minutes, preferably between one and two minutes and most preferably between one and 1.5 minutes.

The inventive process may be conducted to reduce the quantity of collector needed or indeed totally eliminate the quantity of collector, including xanthate collectors, dithiophosphate etc.

Most preferably, the pneumatic flotation cell is a Jameson cell.

In another aspect, the present invention provides a method of improving recovery in a flotation circuit comprising adding as a scalper upstream of the flotation circuit, a pneumatic flotation cell wherein a slurry containing the valuable sulphide mineral is provided to the pneumatic cell and floated at such a rate that the slurry remains in an Eh range suitable for recovery by flotation without the need of a xanthate collector.

The applicant has found that pneumatic cells such as the. Jameson cell subject of Australian patent no 677,542, are ideal for reducing or even eliminating the use of collectors in the flotation of sulphide minerals. Typical pneumatic cells have residence time of less than two minutes, preferably around one to two minutes and most preferably one to 1.5 minutes. They can provide the slightly oxidising environment needed for collectorless flotation while effecting rapid flotation so as to avoid excessive oxidation or increase of the Eh outside the required range where hydroxides are formed on the surface of the minerals.

The process kinetics of pneumatic cells eg Jameson cells, in particular, bubble production and attachment to the particles, are much quicker than conventional mechanical cells. To explain, in a Jameson cell downcomer, the bubbles are created, collide with the particles and attach/to the hydrophobic surface of the valuable sulphide mineral particles in approximately 30 seconds. The downcomer in a Jameson Cell generates a very high shear environment which, when combined with high air voltage (40–50%) and super-fine bubbles (400 microns) result in intense and rapid particle collection.

The actual contacting time in a Jameson downcomer is only a few seconds. The slurry leaves the downcomer and enters a separation tank where the valuable sulphide mineral particles with the bubbles already attached quickly separate from the remainder of the slurry, for example, in approximately one minute, giving a total residence time preferably less than 2 minutes. On the other hand the total residence time required in conventional cells of generally at least 3 to 4 minutes is a reflection of the inherent inefficiencies of the system and the requirement for multiple contacting episodes.

Mechanical cells require bubbles to be created by a mechanical means eg an impeller. The bubble collision and attachment steps as well as the separation process all occur within the same tank. This requires a much greater residence time to allow the bubbles to be created, attached to the particles and then separate from the slurry. This greater residence time simultaneously increases oxidation and Eh of the slurry thereby reducing the effectiveness of collectorless flotation.

It should be understood that the Eh of the slurry in the Jameson Cell is essentially uncontrolled. To explain, once the determination of the appropriate Eh has been made and the slurry is within that range when it is provided to the Jameson Cell, the Eh of the slurry is allowed to fluctuate as it naturally will do so in the presence of air. Generally this will increase the Eh value due to oxidation of the particles. While Eh fluctuation of the slurry is allowed to occur naturally, the invention provides that flotation occurs so rapidly as to avoid the Eh of the slurry going outside the range for collector free flotation.

BRIEF DESCRIPTION OF THE DRAWINGS

So that the present invention may be more clearly understood it: will now be described by way of example only, with reference to the following drawings in which.

BEST MODE(S) FOR CARRYING OUT THE INVENTION

Figure 1:
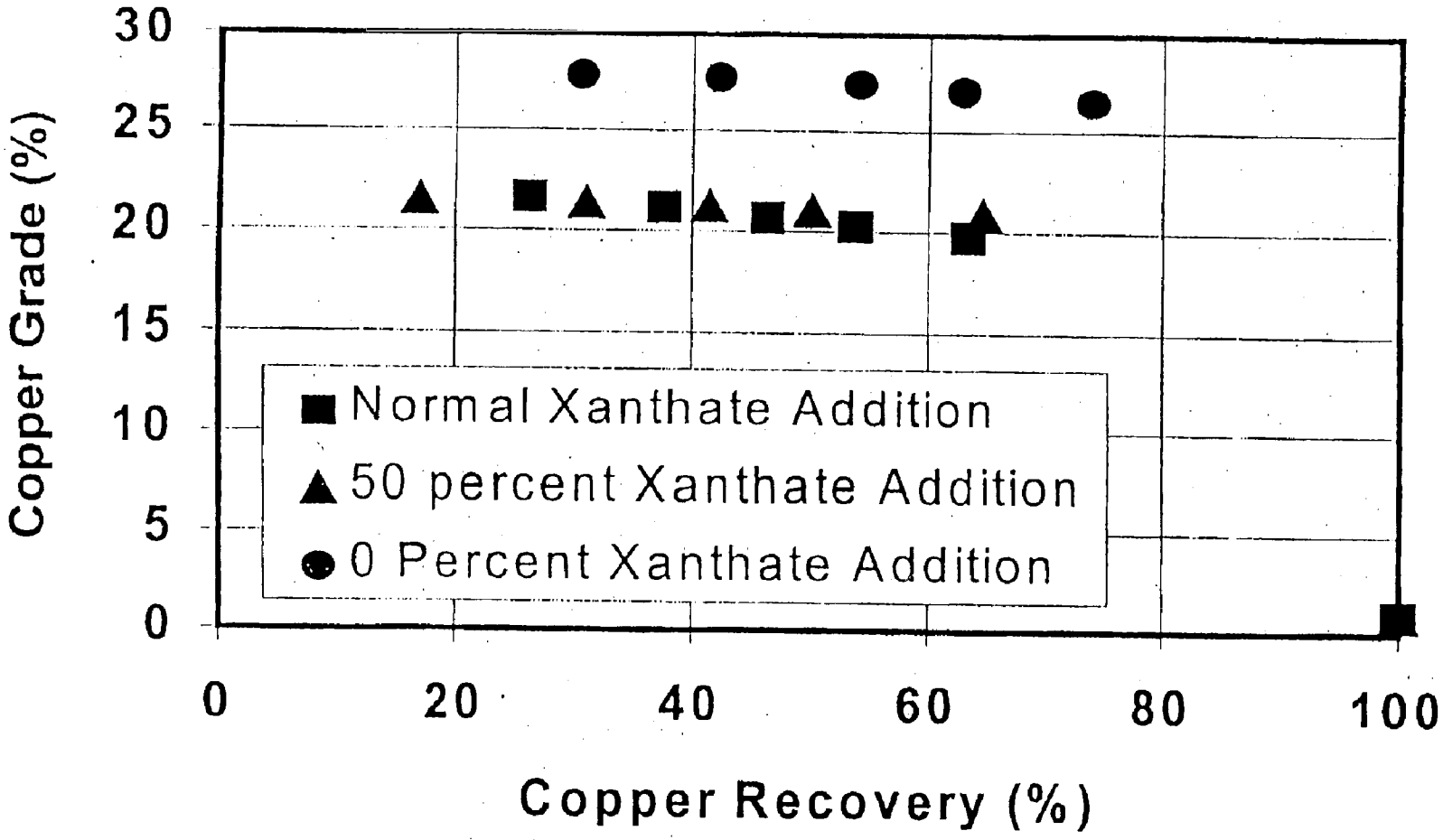
FIG. 1 is a graph comparing conventional flotation techniques with those of the present invention.

An electrochemical investigation was firstly conducted using a specially built chalcopyrite mineral electrode immersed in water from the site where the Jameson Cell would be operated. The major aim of this investigation was to determine the electrochemical response of chalcopyrite in the aqueous environment of the concentrator where the pneumatic cell, such as a Jameson Cell, would be installed and tested and the appropriate Eh range for collectorless flotation of the ore.

A 15 liter sample of water was collected from the concentrator. Chalcopyrite and chalcocite electrodes were prepared and cyclic voltamograms were conducted using the electrode in the water from the concentrator. The cyclic voltamogram study was conducted sing an ADInstrument Potentiostat driven by a MacLab 4e data acquisition system using 'Echem' software. The reference electrode used was a Ag/AgCl electrode. A platinum electrode was used as an auxiliary electrode. The electrode was-cleaned prior to the scan by running it over a fine emery paper to allow a fresh surface to be available for analysis.

The gold electrode was immersed in the water from the concentrator and produced a featureless scan. However, where the chalcopyrite electrode was used, a peak around 0.1 volt was observed, indicating the oxidation of the $S^{2-}$ to $S^0$ from the following equation:

$$CuFeS_2+H_2O=CuS+Fe(OH)_3+S^0+3H++3e$$

This result is consistent with voltamograms from Gardner and Woods (1979).

A scan of a chalcocite electrode under $N_2$ purge in the concentrator water showed a scan indicating the following: In the anodic scan chalcocite $Cu_2S$ is oxidised to covellite CuS at around −0.2 v. At around 0.4 v the covellite is further oxidised forming $Cu^{2+}$ions and most likely forming CuO and $Cu(OH)_2$. Beyond 0.6 v, further oxidation is seen to occur possibly forming more CuO and $Cu(OH)_2$ on the surface of the electrode. $Cu^2$+is not stable in an alkaline environment and would form $Cu(OH)_2$ and precipitate on the surface of the electrode. This formation of $Cu(OH)_2$ on the surface makes chalcocite not able to float in a collectorless system at high Eh.

This scan indicates that $S^0$ is not formed in the oxidation of $Cu_2S$ near the region where $S^0$ is formed in the oxidation of chalcopyrite. There is no peak occurring in the 0.1 v region of the scan, as compared to the chalcopyrite electrode.

The approach that may be taken in some situations where the ore contains chalcopyrite and chalcocite is to float the minerals at about say 0.1 v SHE and add a non-xanthate collector. This means that the chalcopyrite will float in "collectorless" mode using $S^0$ and the chalcocite will float using a non-xanthate collector. This will minimise the flotation of pyrite mineral.

It would be appreciated that similar determination of suitable Eh range for collectorless flotation can be applied to a number of ores. Alternatively such determination may come from previous studies, literature etc. which may already have determined the appropriate Eh range for each individual ore.

The treatment of a chalcopyrite ore in an industrial scale pneumatic cell in a collector free environment was investigated within the electrochemical regime determined in the above electrochemical study. The present test was conducted at Site A which treats a porphyry copper ore which contains predominantly chalcopyrite as the copper mineral, as well as some amount of chalcocite. The ore also contains pyrite and siliceous gangue.

Porphyry copper orebodies are typically characterised by free-milling coarse-grained minerals. This allows a coarse primary grind followed by regrinding of flotation concentrates to achieve final liberation while minimising overall grinding requirements.

During primary grinding a proportion of the copper minerals will be fully liberated due to the overlapping nature of the sizing distribution of the ground material and the liberation profile of the ore. The proportion of liberated copper can be very significant. At the test site the liberation of level of the major copper minerals are at least 80%, indicating these materials could be extracted to a final product prior to regrinding processes. Conventional flotation technology has been unable to achieve such a separation in a single unit due to the slow flotation kinetics, poor selectivity into the froth phase and the use of chemical reagents that encourage sulphide gangue activation.

To illustrate the effect that rapid kinetics and reduced collector has on the flotation system, preliminary laboratory tests were conducted using standard laboratory flotation cells at the test site. The standard test site flotation test procedure was modified to simulate fast kinetics by collecting separate concentrates over 30 second intervals. Tests were performed using standard reagent schemes as a comparison. Examples of the results are shown in tables 1 and 2 with table 3 for comparison purposes below and graphically in FIG. 1. The graph of FIG. 1 clearly shows the collectorless system is on a distinctly different grade/recovery curve that more closely resembles the liberation profile. Later work using improved techniques and fresh samples actually gave improved results and showed final grade concentrates of over 30% copper were achievable.

TABLE 1

FLOTATION TEST 1 - CHALCOPYRITE ORE FROM SITE A

| PRODUCT | WT (GRS) | % Cu | % Fe | % Mo | Dist. Cu | Dist. Fe | Dist. Mo |
|---|---|---|---|---|---|---|---|
| 0–30" Con | 36.2 | 32.30 | 13.60 | 0.53 | 76.63 | 40.76 | 29.12 |
| 30–60" Con | 9.2 | 16.40 | 8.35 | 1.18 | 9.89 | 6.36 | 16.48 |
| 0–60" Cum Con | 45.4 | 29.08 | 12.54 | 0.66 | 88.52 | 47.12 | 45.6 |
| 60–90" Con | 7.4 | 3.47 | 2.09 | 1.16 | 1.68 | 1.28 | 13.03 |
| 0–90" Cum Con | 52.8 | 25.49 | 11.07 | 0.73 | 88.20 | 48.40 | 58.63 |
| 90–120" Con | 5.7 | 2.58 | 1.14 | 0.76 | 0.96 | 0.54 | 6.58 |
| 0–120" Cum Con | 58.5 | 23.26 | 10.10 | 0.73 | 89.17 | 48.94 | 85.20 |
| 120–180" Con | 6.5 | 0.81 | 0.51 | 0.86 | 0.35 | 0.27 | 8.48 |
| 0–180" Cum Con | 65.0 | 21.01 | 9.14 | 0.75 | 89.51 | 49.21 | 73.69 |
| Nonfloat | 1333.5 | 0.12 | 0.46 | 0.013 | 10.49 | 50.79 | 26.31 |
| HEADS | 1398.5 | 1.09 | 0.86 | 0.047 | 100.00 | 100.00 | 100.00 |

Test 1 Conditions

| | pH | ORP (mV) |
|---|---|---|
| CONDITIONING | 11.10 | 9 |
| Flot 0–30" | 11.05 | −28 |
| Flot 30"–60" | 11.03 | −13 |
| Flot 60"–90" | 11.00 | −6 |
| Flot 90"–120" | 10.95 | 0 |
| Flot 120"–180" | 10.69 | 12 |
| NONFLOAT | 11.10 | −29 |

TABLE 2

FLOTATION TEST 2 - CHALCOPYRITE ORP FROM SITE A

| PRODUCT | WT (GRS) | % Cu | % Fe | % Mo | Dist. Cu | Dist. Fe | Dist. Mo |
|---|---|---|---|---|---|---|---|
| 0–30" Con | 34.5 | 31.60 | 15.20 | 0.61 | 75.25 | 29.35 | 31.24 |
| 30–60" Con | 9.9 | 15.60 | 9.50 | 1.13 | 10.66 | 5.26 | 16.61 |
| 0–60" Cum Con | 44.4 | 28.03 | 13.93 | 0.73 | 85.91 | 34.61 | 47.84 |
| 60–90" Con | 6.7 | 4.11 | 3.74 | 1.15 | 1.90 | 1.40 | 11.44 |
| 0–90" Cum Con | 51.1 | 24.90 | 12.59 | 0.76 | 67.81 | 36.02 | 59.28 |
| 90–120" Con | 5.5 | 1.68 | 1.26 | 0.82 | 0.64 | 0.39 | 6.69 |
| 0–120" Cum Con | 56.6 | 22.64 | 11.49 | 0.79 | 88.44 | 36.40 | 65.98 |
| 120–180" Con | 6.2 | 0.91 | 0.62 | 0.87 | 0.39 | 0.22 | 8.01 |
| 0–180" Cum Con | 62.8 | 20.49 | 10.42 | 0.79 | 88.83 | 36.62 | 73.98 |
| Nonfloat | 1348.2 | 0.12 | 0.84 | 0.013 | 11.17 | 63.38 | 26.02 |
| HEADS | 1411.0 | 1.03 | 1.27 | 0.046 | 100.00 | 100.00 | 100.00 |

Test 2 Conditions

| | pH | ORP (mV) |
|---|---|---|
| CONDITIONING | 11.10 | −2 |
| Flot 0–30" | 11.02 | −24 |
| Flot 30"–60" | 11.08 | −9 |
| Flot 60"–90" | 10.96 | −1 |
| Flot 90"–120" | 10.93 | 2 |
| Flot 120"–180" | 10.91 | 11 |
| NONFLOAT | 11.02 | −25 |

TABLE 3

CURRENT PLANTS ASSAYS FOR SITE A USING MECHANICAL FLOAT CELLS

| | | % Cu | % Fe | % Mo |
|---|---|---|---|---|
| Plant assays during sampling | Feed | 1.13 | 1.24 | 0.093 |
| | Prim Con | 17.8 | 10.7 | 0.640 |
| | Final Con | 34.7 | 20.3 | 1.050 |
| | Tails | 0.17 | 0.50 | 0.010 |
| Plant assays for day shift | Feed | 1.29 | 1.24 | 0.054 |
| | Prim Con | 13.00 | 11.60 | 0.710 |
| | Final Con | 34.6 | 19.10 | 1.160 |
| | Tails | 0.13 | 0.45 | 0.009 |

While not wishing to be bound by any particular theory, the applicant believes that if the pulp potential of the slurry remains within a particular Eh range, preferably near neutral and slightly oxidising condition as well as near neutral or slightly alkaline environment, then chalcopyrite can be made to float rapidly without the need of collectors. The applicant believes that pneumatic cells and, in particular, Jameson cells, may be used successfully for ores containing chalcopyrite ($CuFeS_2$) and chalcocite ($Cu_2S$) as these cells operate under a very short residence time. Where the ore contains both chalcopyrite and chalcocite the applicant has found that collector aided flotation may be appropriate. To explain, chalcopyrite may be floated in a "collectorless" mode using $S^0$ with the chalcocite being floated using a non-xanthate collector. This will in turn minimise the flotation of pyrite minerals.

Figure 2:
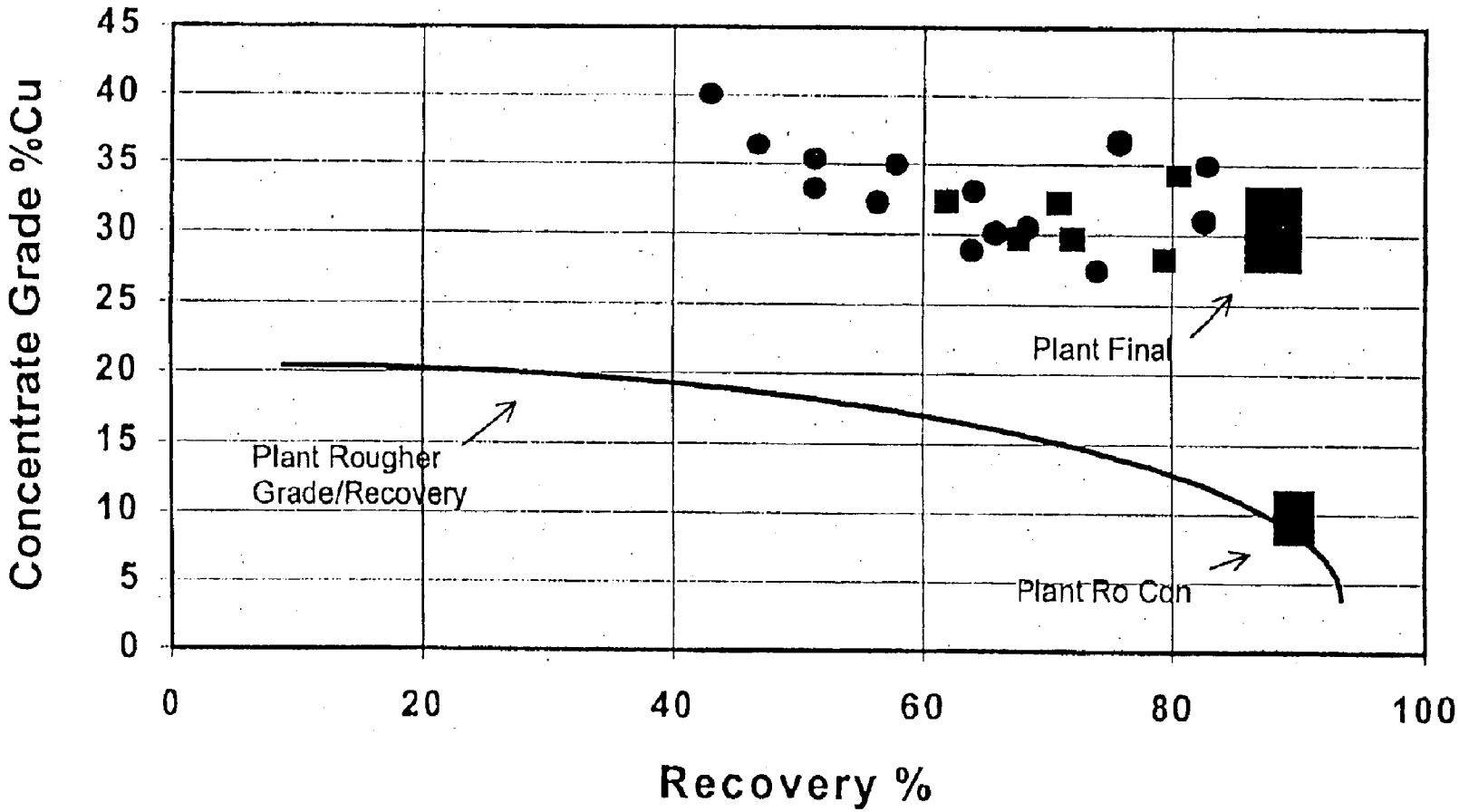
FIGS. 2 and 3 are graphs of grade vs recovery for industrial scale test work in accordance with the present inventions

Plant testing at the test site using a 1,200 tonnes per day industrial scale Jameson Cell produced the results shown in FIG. 2. These results followed the same trend as achieved above. This testing utilised either two or four hourly composite sampling runs and showed good consistency of results. It can be seen that the Jameson Cell results are on a distinctly different grade/recovery curve to that of the conventional cells. Further, a large proportion of the copper is available as final grade material with only a relatively small amount of material requiring further treatment.

Lime is traditionally used to depress pyrite that has been activated by xanthate collector. Since little or no xanthate is used there is no requirement to use lime for this purpose. However, it was found that using the existing frothers at Site-A an alkaline system was still required to give adequate froth conditions. It is anticipated that 30% less lime could be used with alternative frother systems.

The normal frother at the test site is a 4:2:1 blend of D250, MIBC and Pine Oil. During optimisation the frother consumption was halved when Pine Oil was eliminated from the system and a blend of 9:1 D250 and MIBC adopted. The froth conditions were greatly improved with higher product grades achieved.

Figure 4:
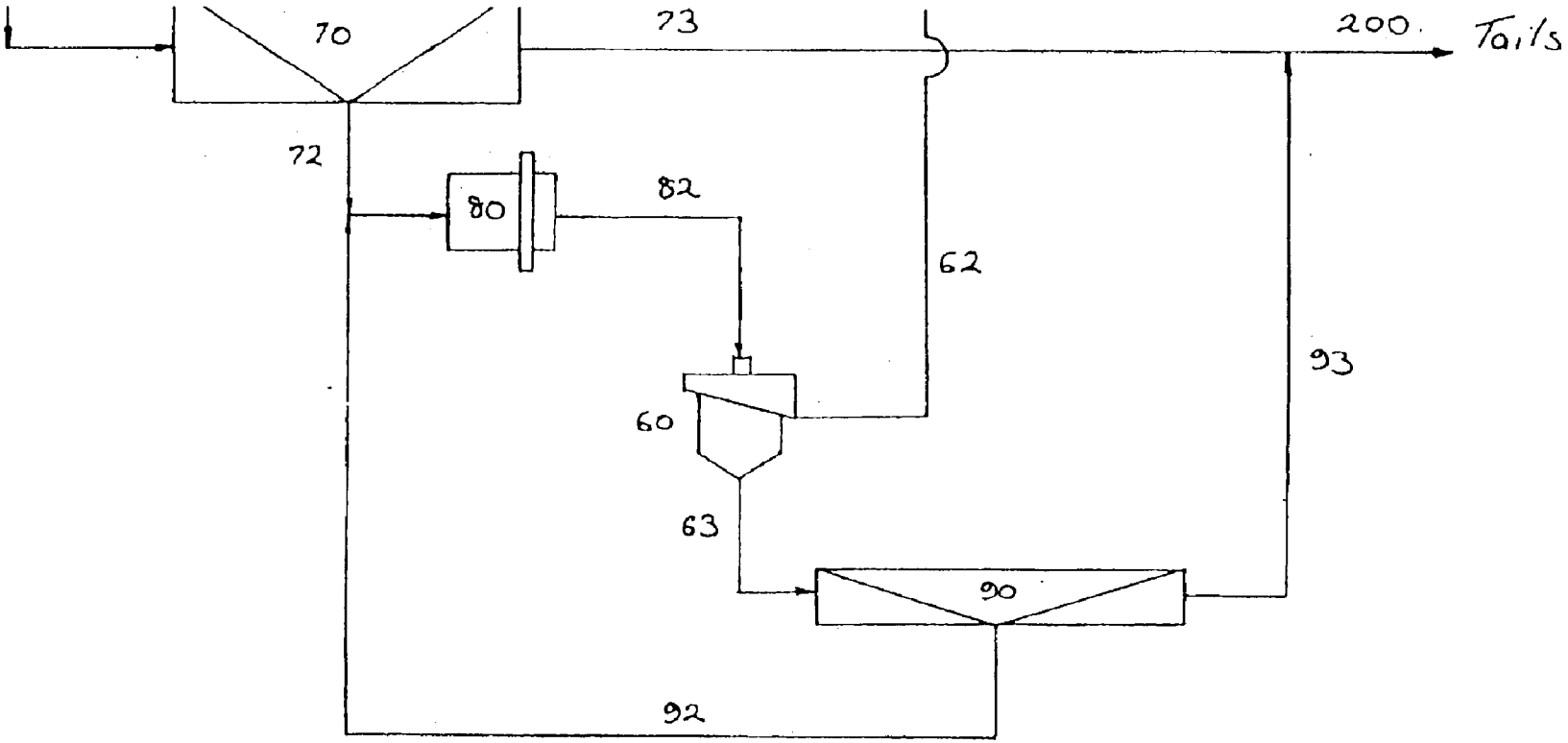
FIG. 4 is a flow sheet of a mineral beneficiation process using the present inventive method.

Some of the test work was performed in a two stage configuration with the first stage acting as a scalper and the second as a scavenger. For example as shown in FIG. 4, the slurry may be initially treated by the pneumatic cell, as a scalper, producing a high grade concentrate.

Feed stream is fed to a Jameson cell. Jameson cell acts as a scalper. The concentrate is fed to the final concentrate stream 100 or alternative for further concentration. The tails leaving the Jameson cell are fed to a primary rougher 70. The rougher tail 73 is fed to the final tail stream 200. The concentrate 72 is reground in mill 80. The reground concentrate 82 is then fed to a second Jameson cell 60 which acts as a scalper for the cleaner circuit. The tail 63 leaving the Jameson cell is fed to a cleaner/scavenger 90. The concentrate 62 leaving the Jameson cell 60 is fed to final concentrate steam 100.

In the cleaner/scavenger cell 90, the concentrate 92 is recycled back to mill 80 for regrinding and feeding to the Jameson cell scalper 60. The cleaner/scavenger tails 93 is fed to the final tail stream 200.

Figure 5:
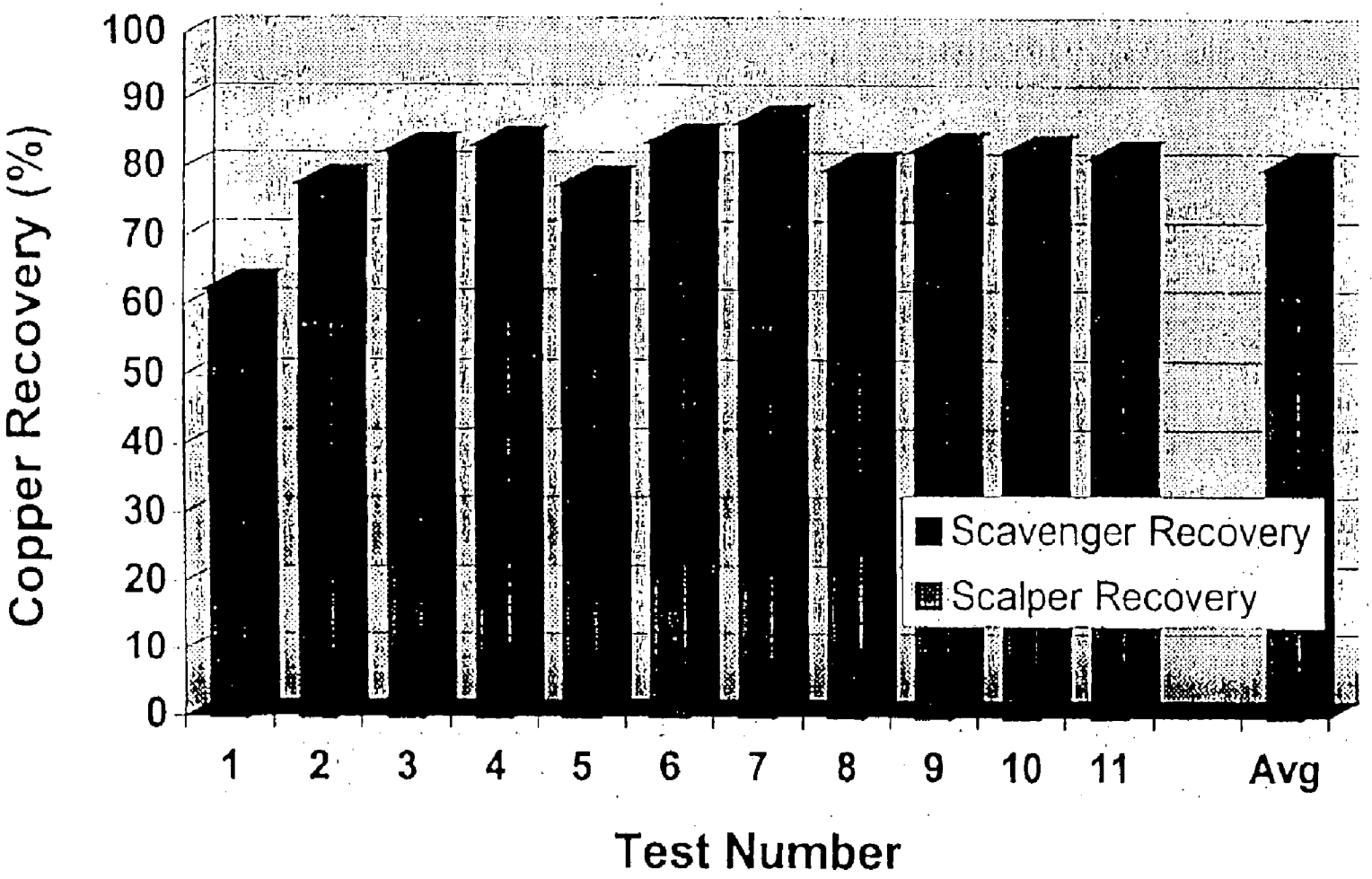
FIG. 5 is a graph showing the improvement in recovery arising from employing the present invention in a mineral beneficiation plant.

The results from this two stage testing are shown in FIG. 5. These indicate excellent recovery from the scalper and further good stability in the flotation circuit in that if the scalper recovery is low for any reason, the remaining stages recoup the losses to give a steady final recovery. The testing was performed with no xanthate collector added. In order to achieve good recoveries of composite particles, a xanthate collector may be required prior to the scavenger stage. This amount of xanthate collector would probably be similar to the usual scavenger dosage levels which would maintain the large overall reduction in collector usage.

While it is possible to reduce the residence time of mechanical cells to avoid the aforementioned over oxidation/high Eh problems, this substantially increases the capital cost for the flotation circuit. As mentioned above, conventional mechanical cells have a minimum residence time of around three to four minutes. If it is desired to reduce the residence time to say two minutes, it will be necessary to reduce the size of each flotation cell which in turn will require an increase in the number of cells to maintain the same throughput. This will vastly increase the capital cost in the plant. It will be appreciated by persons skilled in the art that the simple addition of a pneumatic cell to effect collectorless flotation has a number of benefits including reducing or avoiding the costs associated with collector usage, avoiding the substantial increase in costs which would be required using conventional mechanical cells, reduce power consumption and give better control.

The normal Jameson Cell circuit design for this type of application includes three flotation stages. The target total rougher recovery at the test site is approximately 90%. The full scale testing at the test site has consistently shown that the Jameson Cell can be applied in a scalping duty. In this duty, the concentrate of the Jameson; Cell which is of final grade quality can be sent directly to final concentrate. Further, the incorporation of this scalping step into copper flotation flowsheets simplifies the process remarkably.

To confirm the performances in pneumatic cell further testing was conducted on another copper porphyry concentrator at Site B. The ore treated at Site B consisted of chalcopyrite, diginite, pyrite and non-sulphide gangue minerals. Once again the test was conducted with the Jameson cell acting as a scalper in the absence of xanthate collector.

Figure 3:
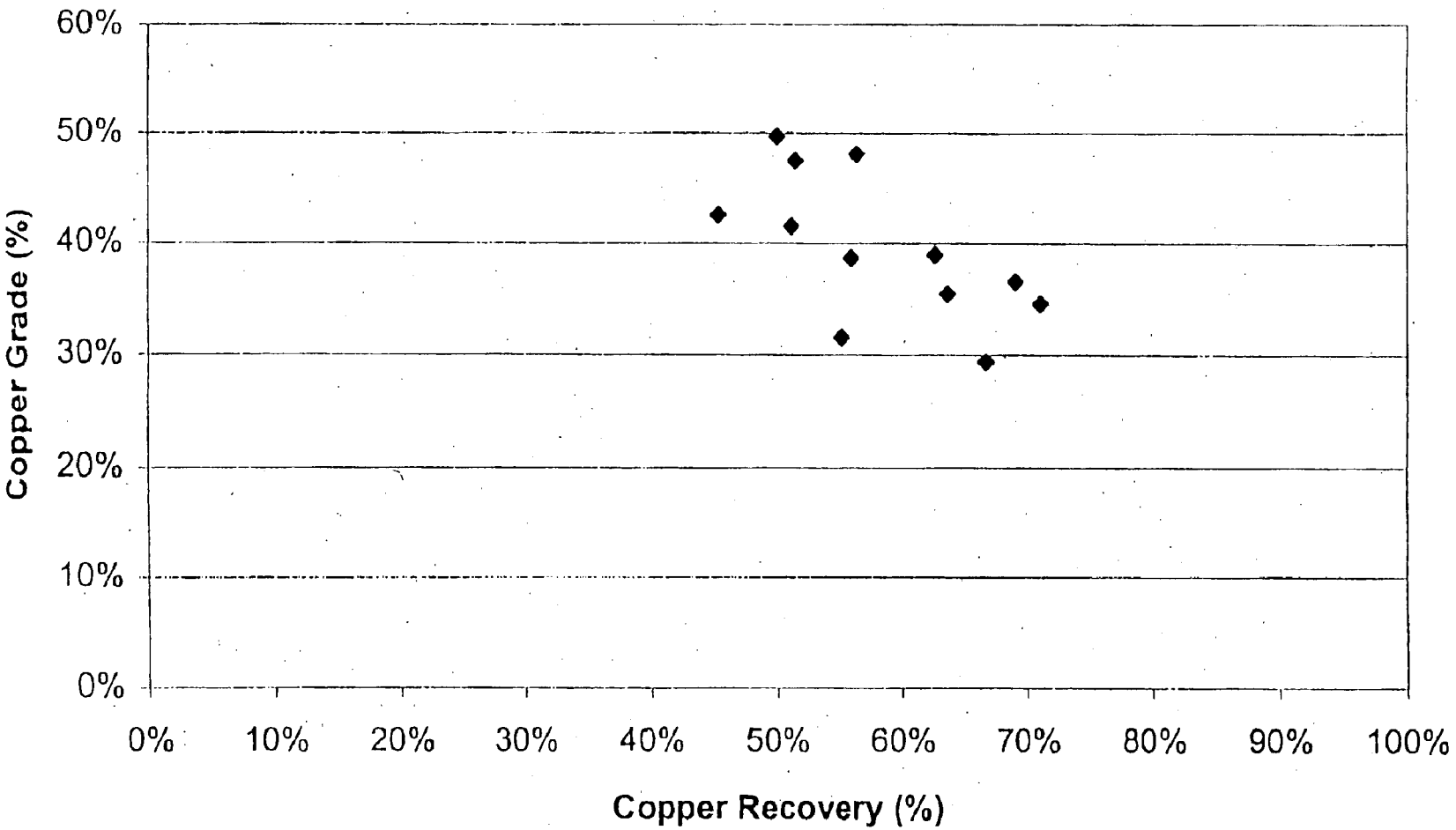

FIG. 3 shows the grade recovery results from the test work at Site B. It once again indicates that the Jameson cell was able to produce clean concentrate with grades equivalent to final concentrate. In comparison, in normal operation the three conventional mechanical cells treating the ore in series provide a 25% copper concentrate equivalent recovery.

Figure 6:
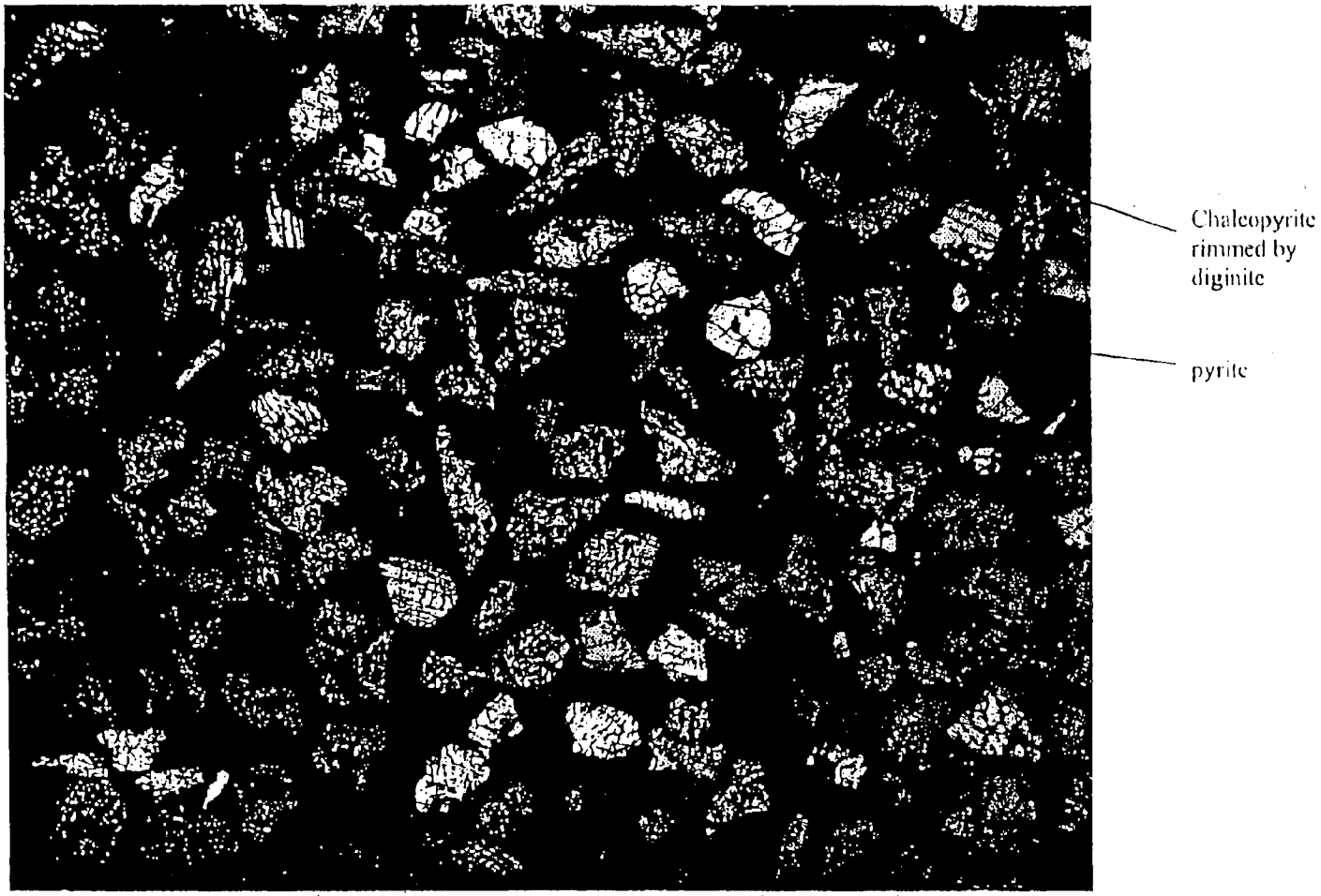
FIGS. 6 and 7 are photomicrographs of the concentrate arising from the industrial scale test work shown in FIG. 3.
Figure 7:
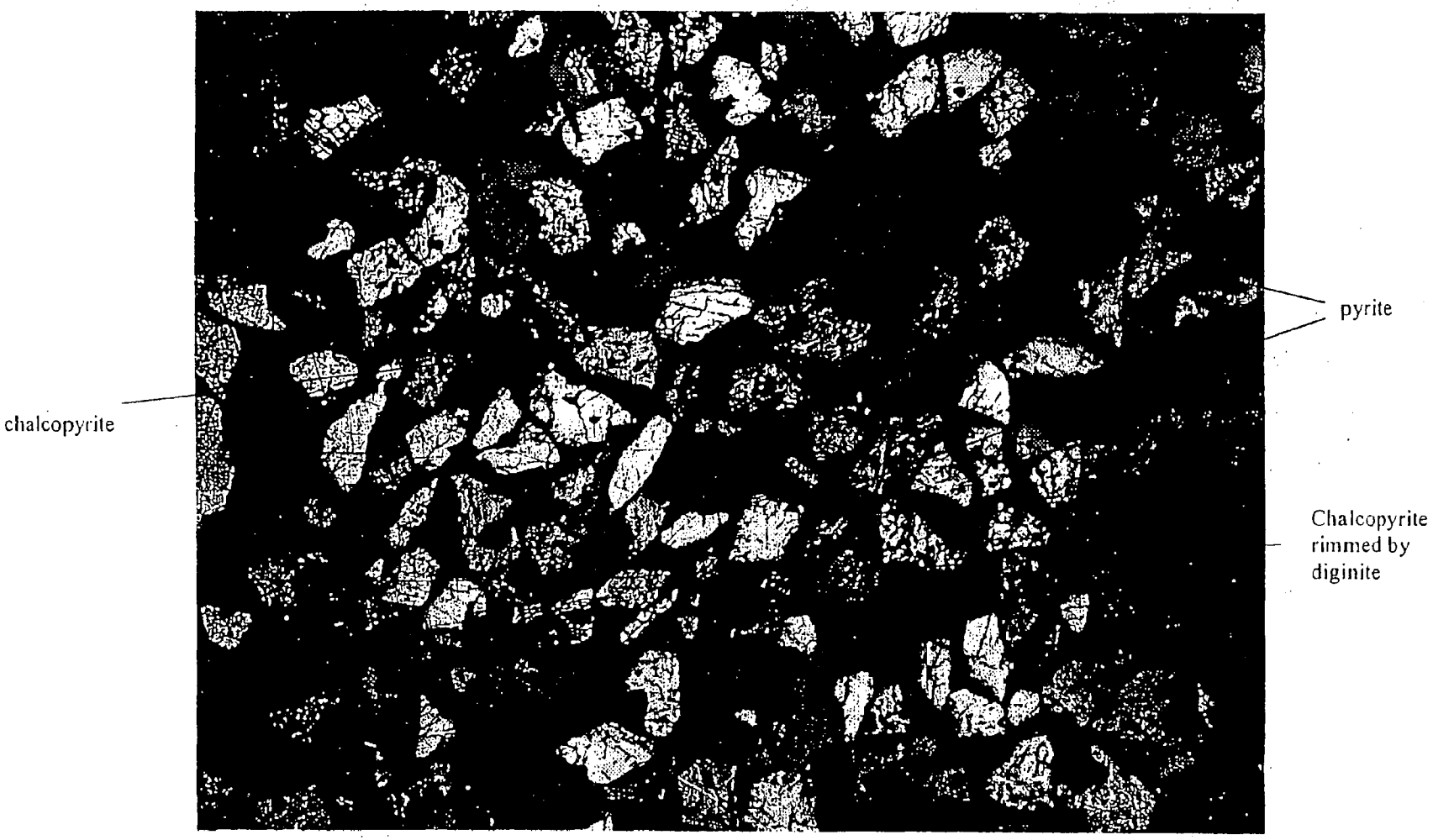

The photomicrographs shown in FIGS. 6 and 7 show the samples recovered from flotation without and with xanthate collector respectively. The grey shade particles represent copper sulphide minerals (with diginite darker than chalcopyrite) and the light almost whiter shade particles of pyrite minerals. It is clear from these photomicrographs that the sample which uses xanthate includes considerably more pyrite than the sample recovered without xanthate collectors. This is one of the clear advantages over and above conventional flotation techniques. Not only does the present invention allow flotation of certain sulphide minerals without the need of collectors but it increases selectivity over certain other selected sulphide minerals, in this case pyrite, which is normally activated by the use of xanthate collectors.

INDUSTRIAL APPLICATION

The present invention exploits the electrochemical properties of sulphide minerals with a fast rate of flotation in a pneumatic cell such as a Jameson Cell. The combination achieved high recovery and excellent selectivity against gangue. Using conventional techniques, the Eh range at which certain ores can be made hydrophobic ie floatable, without the need of a collector is determined. This information is then utilised in industrial environment to recover such ores without the addition of costly collector and with substantial improvement over conventional techniques. The process has significant implications on the design and operation of concentrators including reduction in reagent consumption, reduction in flotation cell and regrinding requirements and production of a coarser finer concentrate product which has additional implications on filtering and drying.

While the present invention has been described by way of reference to Jameson cells, any pneumatic flotation apparatus may be used for the present invention, for example, EKOF cell, Bahr cell, contact cell, Multotec turbo-column etc.

It will be clear to persons skilled in the art that the present invention may be embodied in forms other than that specifically described herein without departing from the spirit or scope of the invention.

What is claimed is:

1. A process for recovery of a valuable sulphide mineral comprising:

providing a slurry containing the valuable sulphide mineral;

determining an Eh range within which the mineral may be recovered by flotation without the need of a collector; and subjecting the slurry to flotation in a pneumatic cell at a rate such that the slurry remains with the Eh range during flotation.

2. A process according to claim 1 wherein the slurry contains both a valuable sulphide mineral and non-valuable sulphide mineral(s), the slurry being subjected to flotation in a pneumatic cell at such a rate that flotation of the selected non-valuable mineral(s) is reduced or eliminated.

3. A process according to claim 1 wherein flotation in the pneumatic flotation cell is conducted at a neutral or slightly oxidising Eh.

4. A process according to claim 1 wherein the Eh range is between −100 mV and +200 mV.

5. A process according to claim 1 wherein the Eh range is between −50 mV and +100 mV.

6. A process according to claim 1 wherein the residence time in the pneumatic cell is below about two minutes.

7. A process according to claim 1 wherein the residence time in the pneumatic cell is between one and two minutes.

8. A process according to claim 1 wherein the residence time in the pneumatic cell is between one and 1.5 minutes.

9. A process according to claim 1 wherein the slurry is conditioned such that it falls within the predetermined Eh range, prior to entry into the pneumatic cell.

10. A process according to claim 1 wherein the rate of flotation is such that the normally required quantity of flotation additives and reagents to achieve the desired grade and recovery are not required.

11. A process according to claim 1 wherein the pneumatic flotation cell is selected from the group consisting of Jameson cells, EKOF cells, Bahr cells, contact cells, and Multotec turbo-column cells.

12. A process according to claim 1 wherein flotation is conducted in a near neutral and slightly alkaline environment.

13. A process according to claim 1 wherein the valuable sulphide mineral is chalcopyrite.

14. A process according to claim 1 wherein the non-valuable sulphide mineral(s) includes pyrite.

15. A process according to claim 1 wherein the Eh range of the slurry within which flotation occurs is that range within which the valuable sulphide mineral may be recovered by flotation without the need of a xanthate collector.

16. A process according to claim 13 wherein the valuable sulphide mineral further comprises chalcocite.

17. A process according to claim 16 wherein the chalcocite is also floated using a non-xanthate collector.

18. A method of improving recovery in a flotation circuit comprising adding a pneumatic flotation cell that functions as a scalper upstream of the flotation circuit, wherein a slurry containing a valuable sulphide mineral is provided to the pneumatic cell and floated at such a rate that the slurry remains in a Eh range suitable for recovery by flotation without the need of a collector.

19. A method according to claim 18 wherein the rate of flotation is selected such that residence time in the pneumatic cell is below about two minutes.

20. A method according to claim 18 wherein concentrate from the pneumatic flotation cell is sent to a final concentrate stream with the tailings from the pneumatic flotation cell being fed to the flotation circuit.

* * * * *